United States Patent [19]

Rebek

[11] 4,054,902

[45] Oct. 18, 1977

[54] APPARATUS FOR DEVELOPING PHOTOGRAPHIC PRINTS

[76] Inventor: Dennis C. Rebek, c/o Flo Nowar, 111 Maple St., Grafton, Wis. 53024

[21] Appl. No.: 546,257

[22] Filed: Feb. 3, 1975

[51] Int. Cl.[2] ..... G03D 3/04

[52] U.S. Cl. ..... 354/329; 354/323; 354/331

[58] Field of Search ..... 354/329, 330, 331, 337, 354/338, 340, 323-327

[56] References Cited

U.S. PATENT DOCUMENTS

| | | | |
|---|---|---|---|
| 3,280,716 | 10/1966 | Gall | 354/323 X |
| 3,304,850 | 2/1967 | Gall | 354/329 |
| 3,381,599 | 5/1968 | Banks | 354/323 |
| 3,623,416 | 11/1971 | Anderberg | 354/323 X |
| 3,724,354 | 4/1973 | Smith | 354/323 X |
| 3,856,395 | 12/1974 | Comstock | 354/331 X |
| 3,864,710 | 2/1975 | Zuber | 354/329 X |
| 3,938,171 | 2/1976 | Masygan | 354/329 X |

FOREIGN PATENT DOCUMENTS

| | | | |
|---|---|---|---|
| 2,048,302 | 4/1972 | Germany | 354/330 |

*Primary Examiner*—R. L. Moses
*Attorney, Agent, or Firm*—Michael, Best & Friedrich

[57] ABSTRACT

Disclosed herein is an apparatus for developing photographic prints including a cabinet which houses a developing tank, a removable hood for covering the developing tank against the entrance of light, a print holding fixture mounted for rotation relative to the developing tank, and a plurality of containers or compartments for storing developing reagents and rinse water. The print holding fixture includes mounting units which are adapted to contact only the opposite outer edge portions of a print and hold it in a plano-arcuate shape with the image or exposed side facing inwardly. The cabinet includes a chamber which jackets or surrounds a major portion of the developing tank and holds warm water for tempering developing reagents and rinse water container in the developing tank. The developing reagent and rinse water containers or compartments are connected to the developing tank by individual conduits including intermediate portions which are located in the lower portion of the chamber and mounted in a coiled fashion so that the warm water tempers the developing reagents and the rinse water prior to their introduction into the developing tank. The apparatus also includes control valves for selectively admitting each reagent and the rinse water into the developing tank and a drain valve for draining the developing tank so that, after installation of a print or prints on the holding fixture, the entire development process can be performed in a lighted room.

12 Claims, 7 Drawing Figures

APPARATUS FOR DEVELOPING PHOTOGRAPHIC PRINTS

BACKGROUND OF THE INVENTION

In developing photographic prints, it is important that the various liquid developing reagents be uniformly distributed over the entire exposed or image portion of the print. Conventional print developing devices typically include some sort of print holding means, such as a drum or the like, on which the print is supported (usually with the exposed or image surface facing outwardly) and which is rotated or oscillated inside a tank or vat containing the developing reagents so as to move the print therethrough. Special care is required to prevent the imaged portion of the print from becoming accidentally scratched during operation of the print holder.

The undeveloped print must be installed on the print holder in the dark. Consequently, the means for securing the print on the print holder should be arranged to facilitate such installation. Also, the mounting means desirably should be capable of holding the print firmly in place without contacting any part of the imaged portion of the print so that damage or disfigurement of the finally developed print is minimized.

SUMMARY OF THE INVENTION

The invention provides an apparatus for developing photographic prints including a tank for receiving and containing developing liquids, a print holding fixture which is mounted inside the developing tank for rotation relative to the developing tank, which includes means for releasably holding one or more prints in a plano-arcuate shape with the exposed or imaged side facing inwardly, and which is adapted to contact only the opposite edge portion of the print, and means for rotating the print holding fixture.

In accordance with a preferred embodiment of the invention, the developing tank is housed in a cabinet which defines a chamber surrounding a major portion of the developing tank and which is adapted to hold warm water for tempering the developing liquids contained in the developing tank during development of the prints.

Also in accordance with the invention, the apparatus is provided with a plurality of containers or compartments for storing the developing reagents and rinse water, individual conduit means connecting each container or compartment in liquid communication with the developing tank and having intermediate portions located inside the cabinet chamber so that each liquid is tempered or preheated by the warm water contained in the chamber prior to introduction into the developing tank, and valve means associated with each conduit means for selectively admitting the respective liquid into the developing tank as required during development. The conduit means preferably are mounted inside the chamber in a circuitous or coiled fashion in order to maximize heating of the liquids by the warm water as they flow enroute to the developing tank.

Further in accordance with the invention, the apparatus is provided with a removable hood for covering the developing tank against the entrance of light and including means for drivingly engaging and rotating the print holding fixture such that the entire development operation can be performed in a lighted room after a print has been installed on the print holding fixture.

The principal feature of the invention is the provision of an apparatus for developing photographic prints which is simple and convenient to operate.

Another principal feature of the invention is the provision of an apparatus for developing photographic prints including a print holding means which is arranged to facilitate installation of the prints in the dark and yet will securely hold the prints in a manner so that damage to the image portion thereof is minimized.

A further feature of the invention is the provision of such an apparatus which is capable of simultaneously developing a plurality of prints and is arranged to permit the entire development process to be carried out in a lighted room.

A still further feature of the invention is the provision of an apparatus for developing photographic prints including means for tempering the developing liquids and maintaining the temperatures thereof within relatively close tolerances to the optimum level desired for development.

Other features, advantages, and aspects of the invention will become apparent upon reviewing the following detailed description, the drawings, and the appended claims.

Figure 2:
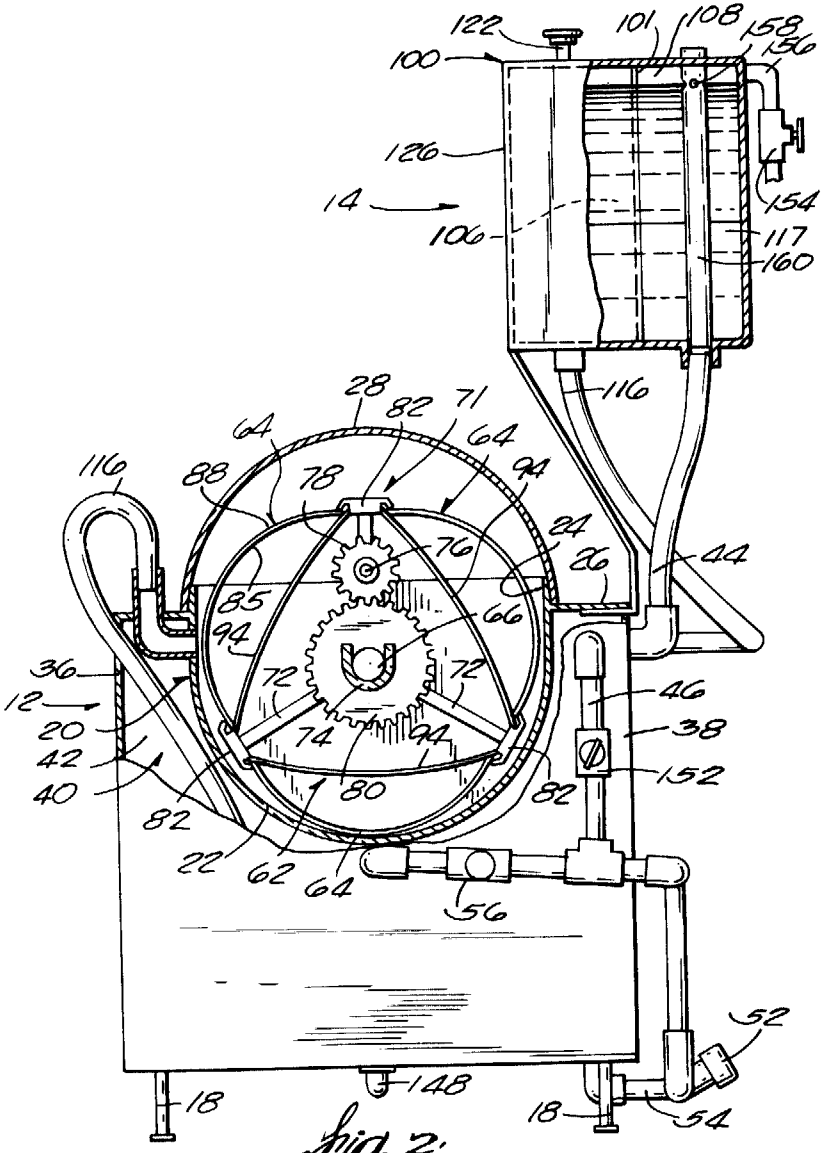
FIG. 2 is a side elevational view, partially broken away and in section, of the apparatus shown in FIG. 1.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Referring to the drawings, the photographic processing apparatus of the invention, designated generally by reference numeral 10, includes a processing section 12 and a reagent storage and dispensing section 14.

The processing section 12 includes an enclosed cabinet 16 mounted on legs 18. Mounted inside the cabinet 16 for receiving and retaining a quantity of the different liquid reagents and rinse water used for developing a photographic print is an elongated, open-top developing tank 20 having a semicylindrical lower portion 22 and upper wall portions 24 which extend vertically a small distance above the top wall 26 of the cabinet 16 (FIG. 2). As used herein, the term developing liquid means the various conventional liquid reagents used for developing photographic prints and/or rinse water. The interior of the developing tank 20 is enclosed against the entrance of light by a removable, generally semicylindrical cover or hood 28 which fits relatively snugly over the developing tank wall portions 24 and seats against the top surface of the cabinet wall 26.

The bottom wall 30, the side walls 32 and 34, the front wall 36 and the back wall 38 of the cabinet 16 form a reservoir or chamber 40 which jackets or surrounds the developing tank 20. In order to maintain the developing liquids contained in the developing tank 20 at the temperature desired for developing a photographic print, the chamber 40 is substantially filled with warm water 42, such as from a home faucet, to a level where a major portion of the outer surface of developing tank 20 is substantially surrounded with the warm water. To insure efficient and uniform transfer of heat from the warm water 42 so as to temper the developing liquids contained in the developing tank 20, the developing tank preferably is formed from a material having a relatively high thermal conductivity such as stainless steel.

Figure 1:
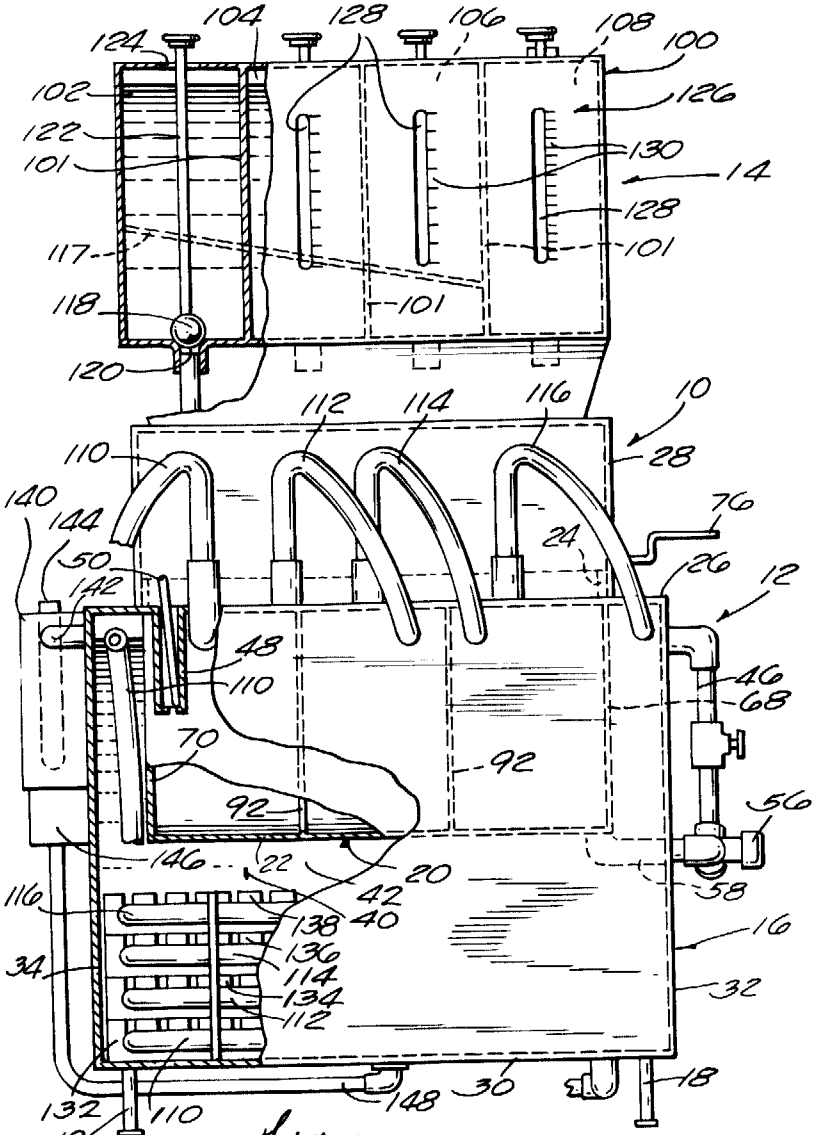
FIG. 1 is a front elevational view, partially broken away, of an apparatus embodying various of the features of the invention.
Figure 3:
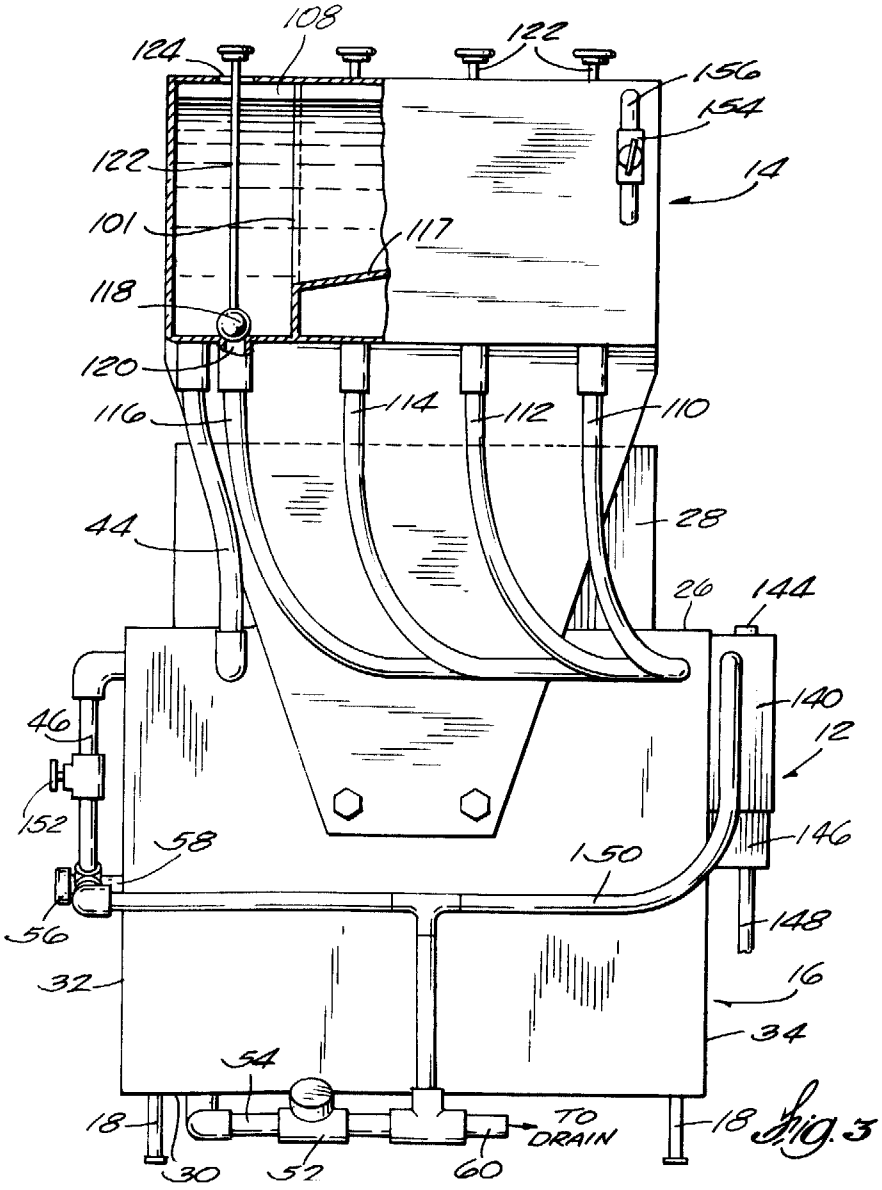
FIG. 3 is a back elevational view, partially broken away, of the apparatus shown in FIG. 1.

In the construction illustrated, warm water is introduced into the chamber 40 through a chamber fill conduit 44 extending through the cabinet back wall 38 (FIGS. 2 and 3). The chamber 40 is filled until the water starts flowing through an overflow line 46 having an inlet located near the top wall 26 of the cabinet 16. Located in the top of the cabinet 16 is an open-bottomed well 48 which extends below the normal level of the water 42 in the chamber 40 and receives a thermometer 50 for monitoring the temperature of the water 42 (FIG. 1). As the temperature of the water 42 drops below the optimum level desired for the developing liquids, additional warm water can be added to the chamber 40 through the chamber fill conduit 44.

The chamber 40 can be drained by opening a valve 52 located in a drain line 54 connected to the bottom of the cabinet 16 (FIGS. 2 and 3). The developing tank 20 can be drained by opening a valve 56 located in a drain line 58 connected to the bottom of the developing tank 20 and extending through the cabinet side wall 32 (FIG. 1). The chamber overflow line 46, the chamber drain line 54 and the developing tank drain line 58 are all connected to an overboard drain line 60 (FIG. 3). These drain lines, particularly the chamber overflow line 46, preferably are formed from a transparent or translucent plastic material so that the presence or absence of flow can be visually observed during filling and draining operations.

Figure 4:
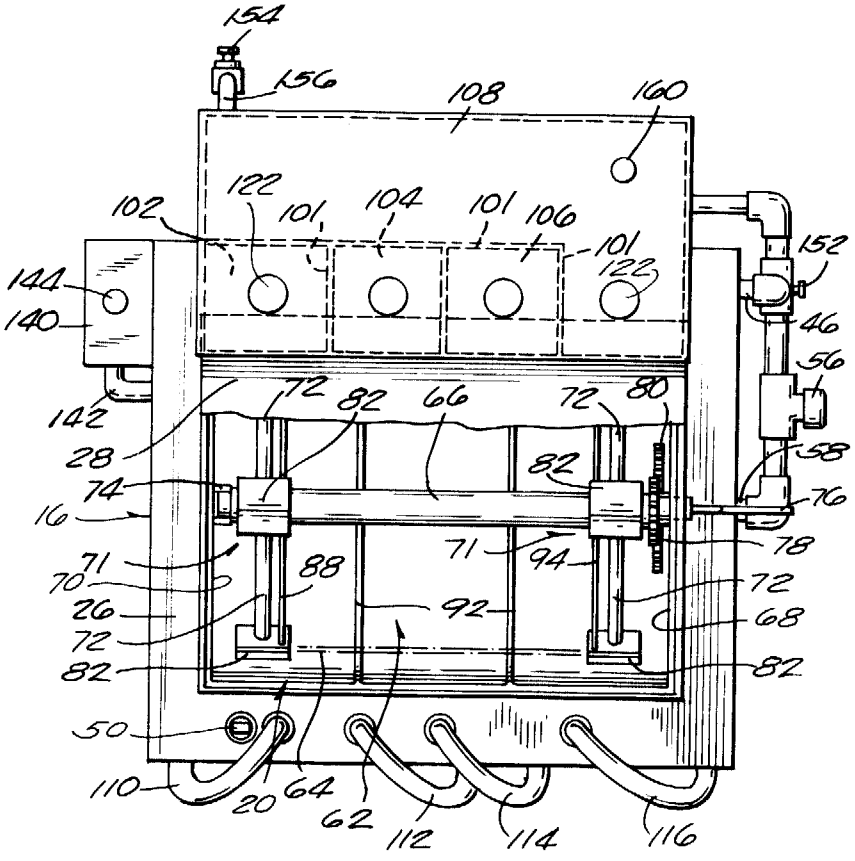
FIG. 4 is a top plan view, partially broken away, of the device shown in FIG. 1.

Mounted for rotation about a horizontal pivot axis relative to the developing tank 20 is a print holding fixture 62 which is adapted to hold one or more photographic prints 64 to be developed (FIGS. 2 and 4). The print holding fixture 62 includes a horizontal shaft 66 which extends between and is rotatably supported from the end walls 68 and 70 of the developing tank 20 and further includes a plurality of axially spaced mounting units 71 having a plurality of radially extending, circumferentially spaced, elongated support arms or members 72 and a mounting bracket 82 located on the outer end of each support member 72 for releasably holding the opposite outer edge portions of a print as described below. To facilitate removal of the print holding fixture 62 for cleaning or the like, the opposite outer ends of the shaft 66 are rotatably received in U-shaped brackets 74 located on the developing tank end walls 68 and 70. Rotatably mounted on the hood 28 for rotating the print holding fixture 62, either clockwise or counterclockwise, is a handcrank 76 carrying a gear 78 which drivingly meshes with a gear 80 carried on the shaft 66.

Figure 6:
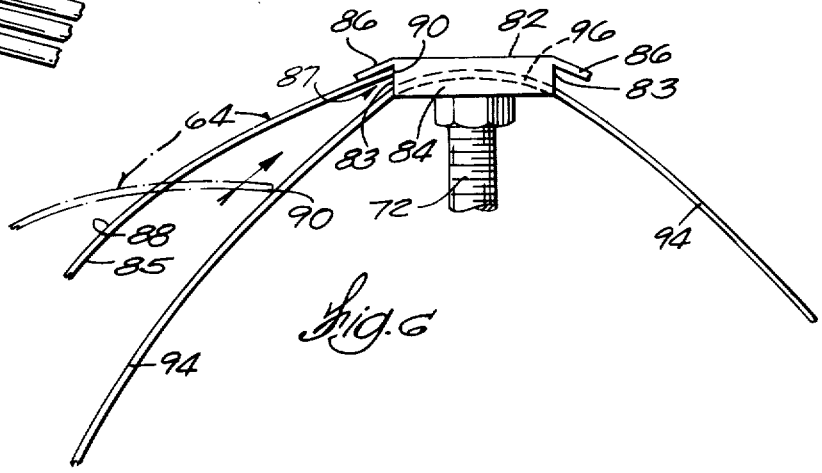
FIG. 6 is an enlarged, fragmentary view of the print holding fixture.

Each mounting bracket 82 includes a main body 84 having opposed shoulders 83, and overhanging lips or flanges 86 which extend outwardly, preferably at a slight radially inward angle, from the shoulders 83 and beneath which an outer edge portion of the print 64 is received (FIG. 6). A print 64 is mounted on the fixture 62 by bending it into a plano-arcuate or bowed shape with the image or exposed side 85 facing inwardly, inserting the opposite edge portions 87 beneath the flanges 86 of circumferentially adjacent pairs of the mounting brackets 82 on axially adjacent mounting unit 71, and then slowly releasing the print (FIGS. 2 and 6). The resilience of the print 64 maintains the outer edge portions 87 in engagement with the mounting brackets 82 beneath the flanges 86 so as to hold the print 64 in place on the mounting units 71 for rotation with the fixture 62. As best shown in FIG. 6, each mounting bracket flange 86 contacts only the unexposed or backside 88 of the print 64 and only the outermost edge 90 of the print 64 engages the mounting bracket shoulder 83. Thus, there is no contact between the mounting brackets 82 and the image portion of the print 64, thereby eliminating, or at least minimizing, damage to the image portion of the finally developed print. A plurality of axially spaced, raised ribs or guides 92 are provided on the bottom of the tank 20 to prevent the backside 88 of the print 64 from rubbing against and becoming snagged on the bottom of the tank during rotation of the fixture 62.

Extending between circumferentially adjacent pairs of the mounting brackets 62 of each mounting unit 71 is a guide wire 94 which serves to assist in guiding the outer edge portions 87 of a print 64 into place beneath the mounting bracket flanges 86 during installation on the fixture 62. The guide wires 94 on axially adjacent mounting units 71 are generally parallel and spaced at a distance slightly less than the length of the print 64. As best shown in FIG. 6, the outermost edges 90 forming the opposite ends of the arc of the bowed print 64 are placed in contact with the guide wires 94 and, as the print 64 is slowly released and allowed to return toward its normal planar shape, these edges ride along the guide wires 94 and are guided thereby into place beneath the mounting bracket flanges 86. With this arrangement, the prints can be conveniently installed onto the fixture 62 in the dark. In the specific construction illustrated, each guide wire 94 is a continuous part and fits into a groove 96 provided on the underside of each mounting bracket 82 and spaced inwardly from the flange 86.

In the specific construction illustrated, the print holding fixture 62 can hold one, two or three prints at one time. If desired the fixture 62 can be arranged to hold only one or several more than three prints at one time. For example, the shaft 66 can be extended and additional mounting units 71 mounted thereon so that two or more axially adjacent rows of prints can be held on the fixture 62 at one time. Also, each mounting unit 71 can include additional support members 72 of longer length and additional mounting brackets 82 so that more than three prints can be accommodated between axially adjacent pairs of mounting units 71.

The reagent storage and dispensing section 14 includes a housing 100 which is located above the developing tank 20 and is suitably supported from the cabinet 16. The housing 100 includes a plurality of internal partitions 101 which cooperate with the walls of the housing 100 to define reagent compartments 102, 104, and 106 for respectively storing a developing solution, a bleaching solution, and a stabilizing solution and a larger compartment or reservoir 108 for storing rinse water. The reagent compartments 102, 104, and 106 and the rinse water reservoir 108 are connected in communication with the developing tank 20 by respective separate dispensing conduits 110, 112, and 114, and 116 which extend through the cabinet chamber 40 and through which the corresponding individual liquids flow by gravity into the developing tank 20. As best shown in FIGS. 1 and 3, a portion of the rinse water reservoir 108 is provided with an inclined bottom 117 to promote gravity feed.

Means are provided for selectively controlling the dispensing of each liquid into the developing tank 20 as required during developing of the prints 64. In the specific construction illustrated, such means comprise a ball valve 118 located in each of the reagent compartments and the rinse water reservoir and normally closing an inlet 120 into each corresponding dispensing conduit. Each ball valve 118 is connected to the lower end of a rod or plunger 122 which extends through an opening 124 provided in the top of the housing 100 for each reagent compartment and the rinse water reservoir and which is lifted or raised to permit the appropriate liquid to flow by gravity into the developing tank 20.

Located on the front 126 of the housing 100 for observing the liquid level in each reagent compartment and the rinse water reservoir are sight windows 128. Also located on the front 126 of the housing 100 adjacent each of the sight windows 128 are graduations 130 which serve as level gauges and have a vertical spacing corresponding to the predetermined quantity of the corresponding liquid required for each developing step. When a particular reagent or rinse water is desired during development, the appropriate plunger 2 is lifted, held in a raised position until the liquid level thereof drops to the proper graduation, and then dropped or pushed downwardly to return the ball valve 118 to the closed position. The housing 100 is preferably constructed from a transparent or translucent material, in which case the sight windows 128 can be omitted.

As mentioned above, the developing liquids contained in the developing tank 20 are tempered by the warm water 42 in the chamber 40 surrounding the developing tank 20. In accordance with a preferred embodiment of the invention, each of the dispensing conduits 110, 112, 114, and 116 are routed in a circuitous or coiled fashion through the lower portion of the chamber 40, as shown in FIG. 1, so that the reagents and the rinse water, while flowing enroute from the dispensing and storage section 14 to the developing tank 20, pass in heat transfer relationship with and are tempered or preheated by the warm water 42 contained in the chamber 40. In addition to minimizing thermal shock to the prints 64, this preheating permits the temperature of the various developing liquids to be controlled within a relatively close tolerance to the optimum temperature for development, e.g., about 100° F.

Figure 7:
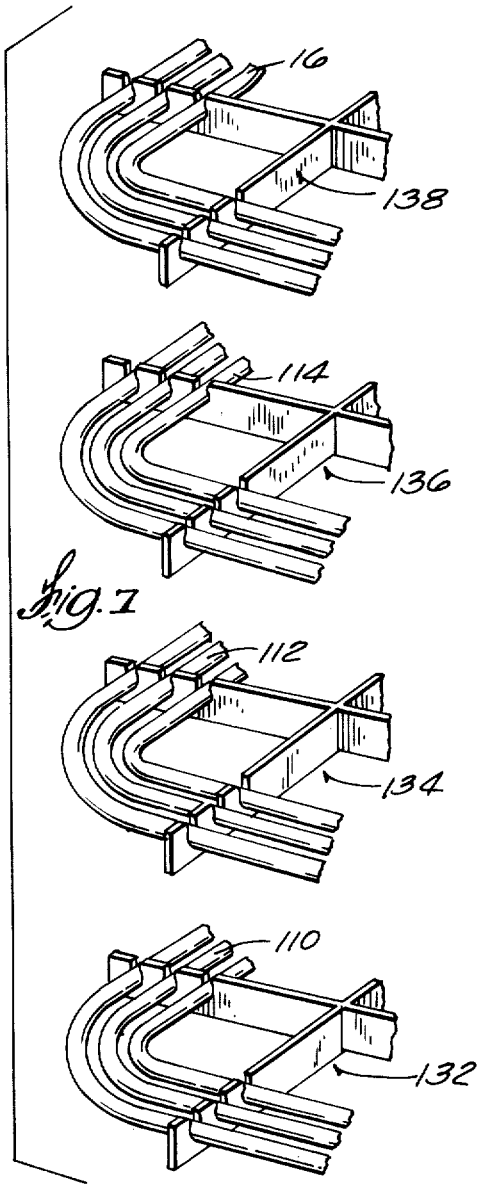
FIG. 7 are fragmentary, perspective views of portions of the dispensing conduits and the support frames therefor.
Figure 5:
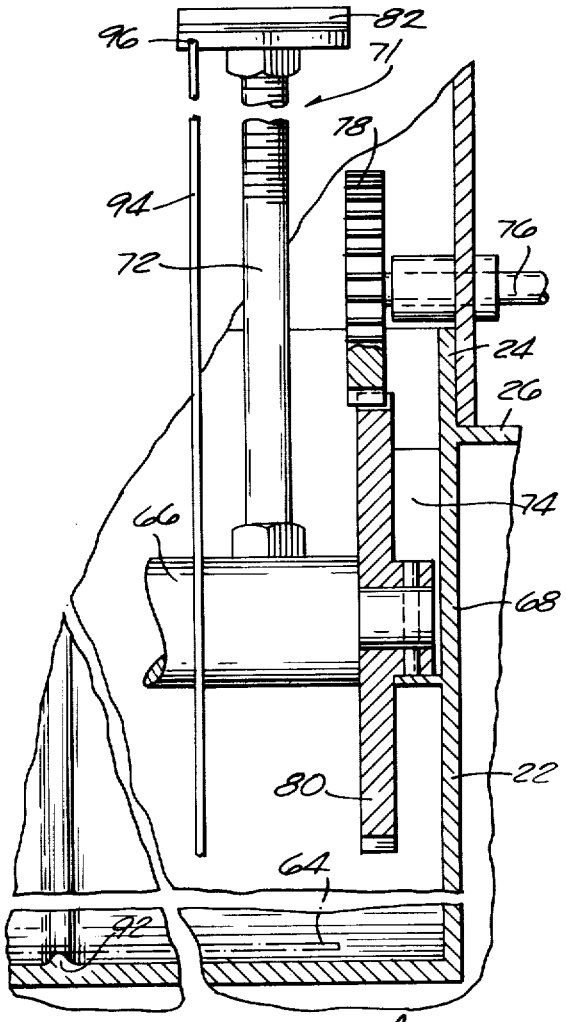
FIG. 5 is an enlarged fragmentary view showing the driving mechanisms for the print holding fixture.

To facilitate installation of the dispensing conduits and to provide a uniform spacing therefor so as to obtain an efficient heat transfer from the warm water 42, each of the conduits 110, 112, 114, and 116 are mounted in a coiled fashion by being fitted into notches in individual frame assemblies 132, 134, 136 and 138 provided for each respective conduit. (FIG. 7). These frame assemblies are stacked on top of each other inside the chamber 40 (FIG. 1).

In accordance with a preferred embodiment, closer control of the reagent and rinse water temperatures can be obtained by providing means for recirculating heated water through the chamber 40. In the specific construction illustrated, such means includes a small reservoir 140 mounted on the side 34 of the cabinet 16 and connected in communication with the upper portion of the chamber 40 by a conduit 142, an immersible electrical heater 144 located inside the reservoir 140 and controlled by a conventional temperature control means such as thermostat (not shown), an electric motor driven pump 146 connected in communication with the reservoir 140, and a return conduit 148 connected between the discharge of the pump 146 and the bottom 30 of the cabinet 16 in communication with the chamber 40. With this arrangement, water is pumped from the chamber 40 into the reservoir 140, where it is heated by the heater 144, and then recirculated to the chamber 40 through the conduit 148. An overflow conduit 150 connected between the reservoir 140 and the overboard drain 60 prevents overfilling of the reservoir 140. When this recirculation feature is used, a valve 152 provided in the chamber overflow conduit 46 is closed to prevent the heated, recirculating water from overflowing into the overboard drain 60.

To facilitate the initial set-up of the apparatus for operation, means are provided so that the chamber 40 and the rinse water reservoir 108 can be filled by making a single connection to a warm water supply. In the specific construction illustrated, warm water from a home faucet 154 or the like is introduced into the apparatus through an inlet 156 located on the upper portion of the housing 100. After the rinse water reservoir 108 is filled to a predetermined level, the water then flows through one or more apertures 158 provided in the upper portion of a standpipe 160 having a lower portion which communicates with the chamber fill conduit 44 (FIG. 2). Thus, after the rinse water reservoir 108 is filled, the water flows through the standpipe 160, through the conduit 44, and into the chamber 40. When the water starts to overflow through the conduit 46 as described above, the faucet 154 is closed and the apparatus is ready for use.

Since a large portion of the rinse water reservoir 108 is located adjacent the back walls of the reagent compartments 102, 104, and 106, the warm rinse water aids in tempering or preheating the reagents prior to their introduction into the developing tank 20.

In use, after the apparatus has been filled with warm water as described above, one or more prints 64 to be developed are installed on the print holding fixture 62 in the dark with the hood 28 removed. After the hood 28 is installed to cover the developing tank 20, all the remaining operations can be performed in a lighted room.

A predetermined quantity of the first reagent is introduced into the developing tank 20 by raising the appropriate plunger 122 until the liquid in the corresponding compartment drops to the next lower graduation 130. The prints 64 are moved through the reagent contained in the developing tank 20 for the prescribed time by turning the hand crank 76 (clockwise, counterclockwise, or both). After completion of the development step, the processing tank 20 is drained by opening the drain valve 56. This same procedure is successively followed for each of the reagents and the rinse water until the development of the prints has been completed.

Following the final rinse, the developing tank 20 is drained by opening the valve 56, the hood 28 is removed, and the developed prints are removed from the fixture 62 by gently bowing them sufficiently to disengage the opposite edge portions 87 from beneath the mounting brackets flanges 86.

From the above description, it can be seen that the apparatus provided by the invention, although simply constructed and convenient to operate by even the most amateur photographer, has several distinct advantages. For instance, several photographic prints can be developed at one time under exactly the same operating conditions, thereby insuring the same quality development for all. Scratching or other disfigurement of the image portion of a developed print is minimized because only non-image portions are contacted by any part of the holding fixture and the exposed or image side is held facing inwardly thereby preventing accidental rubbing against the bottom or any other portion of the developing tank. The temperature of the developing reagents and the rinse water can be easily controlled within relatively close tolerances, particularly when the water recirculating feature is included in accordance with a preferred embodiment. After an initial set-up of the apparatus, several separate developments can be performed without further preparation, other than adding warm water as required to maintain the reagent temperatures at a desired level.

Various of the features of the invention are set forth in the following claims:

I claim:

1. An apparatus for developing photographic prints having an exposed side, a back side and spaced outer edges, said apparatus comprising a developing tank for receiving and containing developing liquid, an open fixture mounted inside said developing tank for rotation relative thereto about a pivot axis and through the liquid contained in said tank, said fixture including means for releasably holding at least one photographic print to be developed in a plano-arcuate shape with the exposed side of the print facing inwardly towards said pivot axis, said holding means including inwardly open support means adapted to contact only the outer edges and the back side of the print and being free of engagement with the exposed side of the print, said support means including a pair of circumferentially spaced generally radially extending surfaces located at a circumferential distance therebetween greater then the length of the print between the outer edges thereof and engagable by the outer edges of the print to hold the print in outwardly bowed condition, said support means also including respective flange surfaces extending transversely outwardly from the outer ends of said radially extending surfaces and adapted for engagement with the back side of the print so as to limit radially outward movement of the outer edges of the print, circumferentially extending respective guide surface means located inwardly of said flange surfaces and extending toward each other from said radially extending surfaces for engagement with the outer edges of the print so as to guide said outer edges into engagement with said radially extending surfaces without engaging the exposed side of the print, and means for rotating said fixture about said axis and thereby moving the print through the developing liquid contained in said developing tank.

2. An apparatus for developing photographic prints having an exposed side comprising a developing tank for receiving and containing developing liquid, an open fixture mounted inside said developing tank for rotation relative thereto about a pivot axis and through the liquid contained in said tank, said fixture including a horizontally extending shaft rotatably mounted on said developing tank and means for releasably holding at least one photographic print to be developed in a plano-arcuate shape with the exposed side of the print facing inward towards said pivot axis, said holding means being inwardly open and including a pair of mounting units carried on said shaft in axially spaced relation, each of said mounting units comprising at least two elongated support members extending radially outwardly from said shaft and having at the outer ends thereof, a pair of circumferentially spaced mounting brackets, each bracket having a generally radially extending surface adapted to contact only opposite edges of the print and being free of engagement with the exposed side of the print, and a flange beneath which an outer edge of the print can be inserted, and means for guiding the opposite edges of the print beneath said flanges without engaging the exposed side of the print, said guide means comprising a guide wire extending between circumferentially adjacent mounting brackets and located beneath said flanges, and means for rotating said fixture about said axis and thereby moving the print through the developing liquid contained in said developing tank.

3. An apparatus according to claim 1 including a removable hood for covering said developing tank against the entrance of light, and wherein said means for rotating said fixture comprises drive means rotatably mounted on said hood for drivingly engaging and rotating said fixture.

4. An apparatus according to claim 1 including a cabinet housing said developing tank and defining a chamber surrounding a substantial portion of said developing tank and including an overflow line located above the bottom of said chamber so as to maintain therein a quantity of a tempering liquid in contact with said developing tank.

5. An apparatus according to claim 4 including a plurality of containers for storing developing liquids, individual conduit means connecting each of said containers in liquid communication with said developing tank, said conduit means including intermediate portions located in said chamber in heat transfer relationship with the liquid contained in said chamber, and valve means associated with each of said conduit means for selectively admitting the respective developing liquid into said developing tank.

6. An apparatus according to claim 4 including means mounted on said chamber for heating and recirculating the liquid through said chamber.

7. An apparatus according to claim 6 wherein said heating and recirculating means includes a reservoir connected in liquid communication with said chamber, a heater disposed inside said reservoir, and a pump connected in liquid communication with said reservoir and said chamber for pumping the liquid from said chamber into said reservoir and from said reservoir back into said chamber.

8. An apparatus according to claim 4 including a housing located above said developing tank and supported from said cabinet, said housing including internal partitions defining separate compartments for storing the developing liquids, individual conduit means connecting each of said compartments in liquid communication with said developing tank for introducing the respective developing liquid by gravity into said developing tank, said conduit means including intermediate portions located in said chamber in heat transfer relationship with the liquid contained in said chamber, and valve means associated with each of said conduit means for selectively admitting the respective developing liquid into said developing tank.

9. An apparatus according to claim 8 wherein one of said compartments is adapted to store rinse water and said apparatus further includes chamber fill conduit means connecting said chamber in liquid communication with said rinse water compartment, an inlet in said housing for introducing warm water into said rinse water compartment, a standpipe having upper and lower portions disposed in said rinse water compartment with the lower portion of said standpipe disposed in communication with said chamber fill conduit means, and an aperture located in said standpipe upper portion whereby, after the water level in said rinse water reservoir reaches a predetermined level and the introduction of water through said inlet is continued, the water flows through said standpipe and said chamber fill conduit means into said chamber.

10. An apparatus for developing photographic prints having an exposed side comprising a developing tank for receiving and containing developing liquid, a cabinet housing said developing tank and defining a chamber surrounding a substantial portion of said developing tank and adapted to contain a liquid for tempering developing liquids contained in said developing tank, an open fixture mounted inside said developing tank for rotation relative thereto about a pivot axis and through the liquid contained in said tank, said fixture including means for releasably holding at least one photographic print to be developed in a plano-arcuate shape with the exposed side of the print facing inward towards said pivot axis, said holding means being inwardly open and including a generally radially extending surface adapted to contact only opposite edges of the print and being free of engagement with the exposed side of the print, means for rotating said fixture about said axis and thereby moving the print through the developing liquid contained in said developing tank, a plurality of containers for storing developing liquids, individual conduit means connecting each of said containers in liquid communication with said developing tank, said conduit means including intermediate portions located in said chamber in heat transfer relationship with the liquid contained in said chamber, valve means associated with each of said conduit means for selectively admitting the respective developing liquid into said developing tank, and frame means for holding said intermediate portions of each of said conduit means in a coiled fashion, said frame means being disposed in a stacked relation inside said chamber.

11. An apparatus for developing photographic prints having an exposed side, a back side, and spaced outer edges, said apparatus comprising a developing tank for receiving and containing developing liquids, a cabinet housing said developing tank and defining a chamber surrounding a substantial portion of said developing tank and adapted to contain a liquid for tempering developing liquids contained in said developing tank, a fixture for releasably holding at least one print to be developed, said fixture including a horizontal shaft mounted inside said developing tank for relative rotation, a pair of axially spaced mounting units carried on said shaft each including a pair of circumferentially spaced support members extending radially from said shaft and having an outer end, a mounting bracket carried on the outer end of each support member, each mounting bracket being inwardly open and including a generally radially extending surface adapted to engage one of the opposite edges of the print and to cooperate with the circumferentially adjacent mounting bracket to releasably hold a print in a plano-arcuate shape with the exposed side facing inwardly toward said shaft and without engagement of the exposed side of the print by said mounting brackets, each mounting bracket also including respective flange surfaces extending transversely outwardly from the outer ends of said radially extending surfaces and adapted for engagement with the back side of the print so as to limit radially outward movement of the outer edges of the print, circumferentially extending respective guide surface means located inwardly of said flange surfaces and extending toward each other from said radially extending surfaces for engagement with the outer edges of the print so as to guide said outer edges into engagement with said radially extending surfaces without engaging the exposed side of the print, and a removable hood for covering said developing tank againt the entrance of light and including drive means rotatably mounted thereon for drivingly engaging and rotating said shaft, thereby moving the print through the developing liquid contained in said developing tank.

12. An apparatus according to claim 11 including a housing located above said developing tank and supported from said cabinet, said housing including internal partitions defining separate compartments for storing the developing liquids, individual conduit means connecting each of said compartments in liquid communication with said developing tank for introducing the respective developing liquid by gravity into said developing tank, said conduit means including intermediate portions located in said chamber in heat transfer relationship with the liquid contained in said chamber, and valve means associated with each of said conduit means for selectively admitting the respective developing liquid into said developing tank.

* * * * *